US006766805B1

(12) United States Patent
Cupp

(10) Patent No.: US 6,766,805 B1
(45) Date of Patent: Jul. 27, 2004

(54) HAIR HIGHLIGHTS ATTACHMENT ASSEMBLY

(76) Inventor: Paula C. Cupp, 723 Caladium Dr., Mesquite, TX (US) 75149

( * ) Notice: Subject to any disclaimer, the term of this patent is extended or adjusted under 35 U.S.C. 154(b) by 107 days.

(21) Appl. No.: 10/251,055

(22) Filed: Sep. 23, 2002

(51) Int. Cl.[7] ..... A41G 3/00; A45D 8/04; A45D 8/12

(52) U.S. Cl. ..... 132/53; 132/273; 132/275

(58) Field of Search ..... 132/53, 273, 275, 132/54, 56, 274; 2/171, 172, 202, 207, 209.12

(56) References Cited

U.S. PATENT DOCUMENTS 4,804,003 A * 2/1989 Moen ..... 132/53
5,337,763 A * 8/1994 Haber et al. ..... 132/54
5,493,735 A * 2/1996 Rice ..... 2/209.13
5,806,535 A * 9/1998 Becker ..... 132/54
6,131,585 A * 10/2000 Reinstein et al. ..... 132/275

FOREIGN PATENT DOCUMENTS

JP 2000053222 * 2/2000

* cited by examiner

*Primary Examiner*—John J. Wilson
*Assistant Examiner*—Robyn Doan

(57) ABSTRACT

A hair highlights attachment assembly for providing highlight strands for medium to long, one-length or layered hair. The hair highlights attachment assembly includes a highlight strands support member being adapted to be removably disposed about a user's hair and head; and also includes fasteners being attached to the highlight strands support member; and further includes a plurality of highlight strands being detachably attached to the highlight strands support member; and also includes fastening members being attached to the highlight strands.

1 Claim, 4 Drawing Sheets

HAIR HIGHLIGHTS ATTACHMENT ASSEMBLY

BACKGROUND OF THE INVENTION

1. Field of the Invention

The present invention relates to hair highlights attachments and more particularly pertains to a new hair highlights attachment assembly for providing highlight strands for medium to long, one length or layered hair.

2. Description of the Prior Art

The use of hair highlights attachments is known in the prior art. More specifically, hair highlights attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,019,107; U.S. Pat. No. 5,337,763; U.S. Pat. No. 5,357,986; U.S. Pat. No. 4,966,173; U.S. Pat. No. 5,551,455; and U.S. Pat. No. Des. 433,774.

While these devices fulfill their respective, particular objectives and requirements, the aforementioned patents disclose a new hair highlights attachment assembly. The prior art includes clips and synthetic and real strands of hair depending from the clips which are attached to user's hair.

SUMMARY OF THE INVENTION

The general purpose of the present invention, which will be described subsequently in greater detail, is to provide a new hair highlights attachment assembly which has many of the advantages of the hair highlights attachments mentioned heretofore and many novel features that result in a new hair highlights attachment assembly which is not anticipated, rendered obvious, suggested, or even implied by any of the prior art hair highlights attachments, either alone or in any combination thereof. The present invention includes a highlight strands support member being adapted to be removably disposed about a user's hair and head; and also includes fasteners being attached to the highlight strands support member; and further includes a plurality of highlight strands being detachably attached to the highlight strands support member; and also includes fastening members being attached to the highlight strands. None of the prior art includes the arcuate hair/head band and the fasteners and fastening members of the present invention.

There has thus been outlined, rather broadly, the more important features of the hair highlights attachment assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new hair highlights attachment assembly which has many of the advantages of the hair highlights attachments mentioned heretofore and many novel features that result in a new hair highlights attachment assembly which is not anticipated, rendered obvious, suggested, or even implied by any of the prior art hair highlights attachments, either alone or in any combination thereof.

Still another object of the present invention is to provide a new hair highlights attachment assembly for providing highlight strands for medium to long, one-length or layered hair.

Still yet another object of the present invention is to provide a new hair highlights attachment assembly that is easy and convenient to set up and use.

Even still another object of the present invention is to provide a new hair highlights attachment assembly that allows the user to fix one's hair in much less time than with other types of hair highlight kits.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
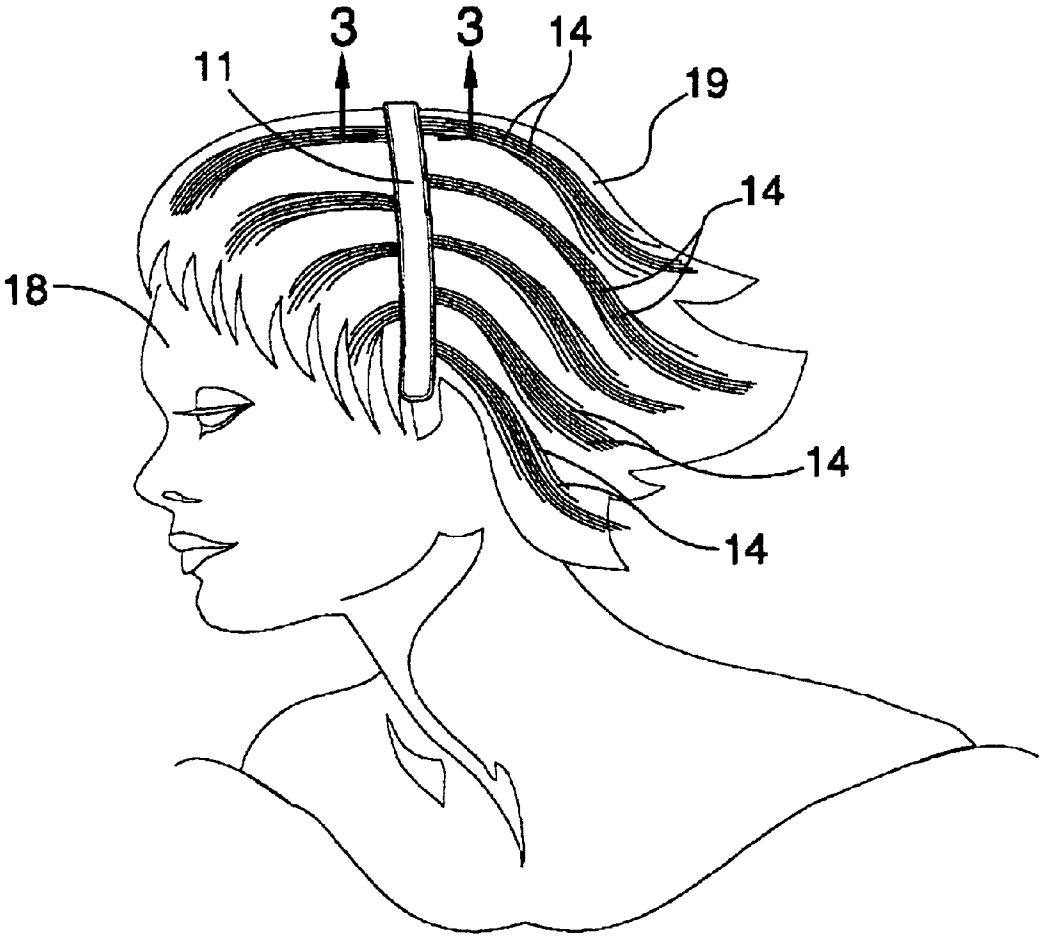
FIG. 1 is a side elevational view of a new hair highlights attachment assembly according to the present invention.
Figure 2:
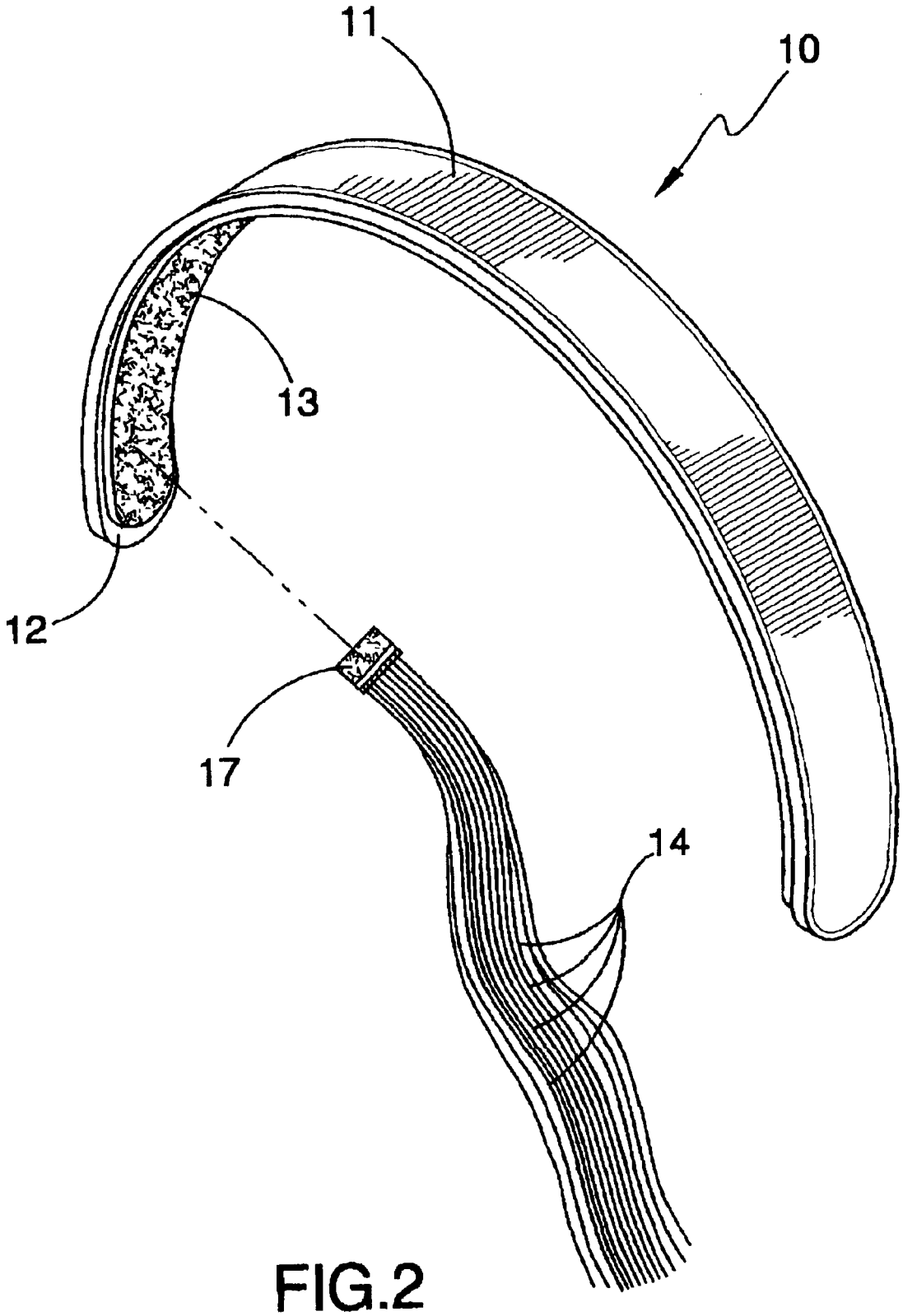
FIG. 2 is a perspective view of the present invention.
Figure 3:
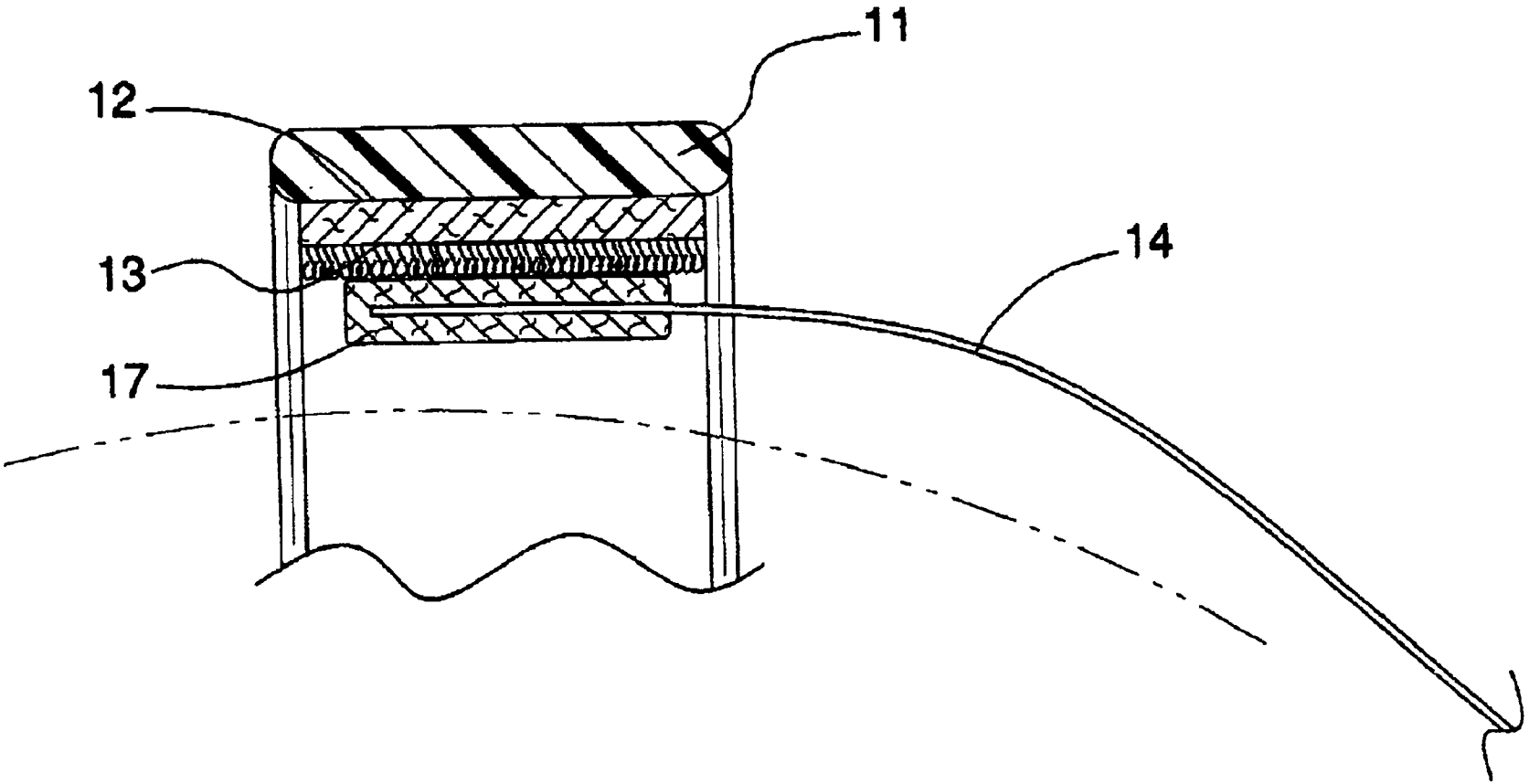
FIG. 3 is a cross-sectional view of the highlight strands support member of the present invention.
Figure 4:
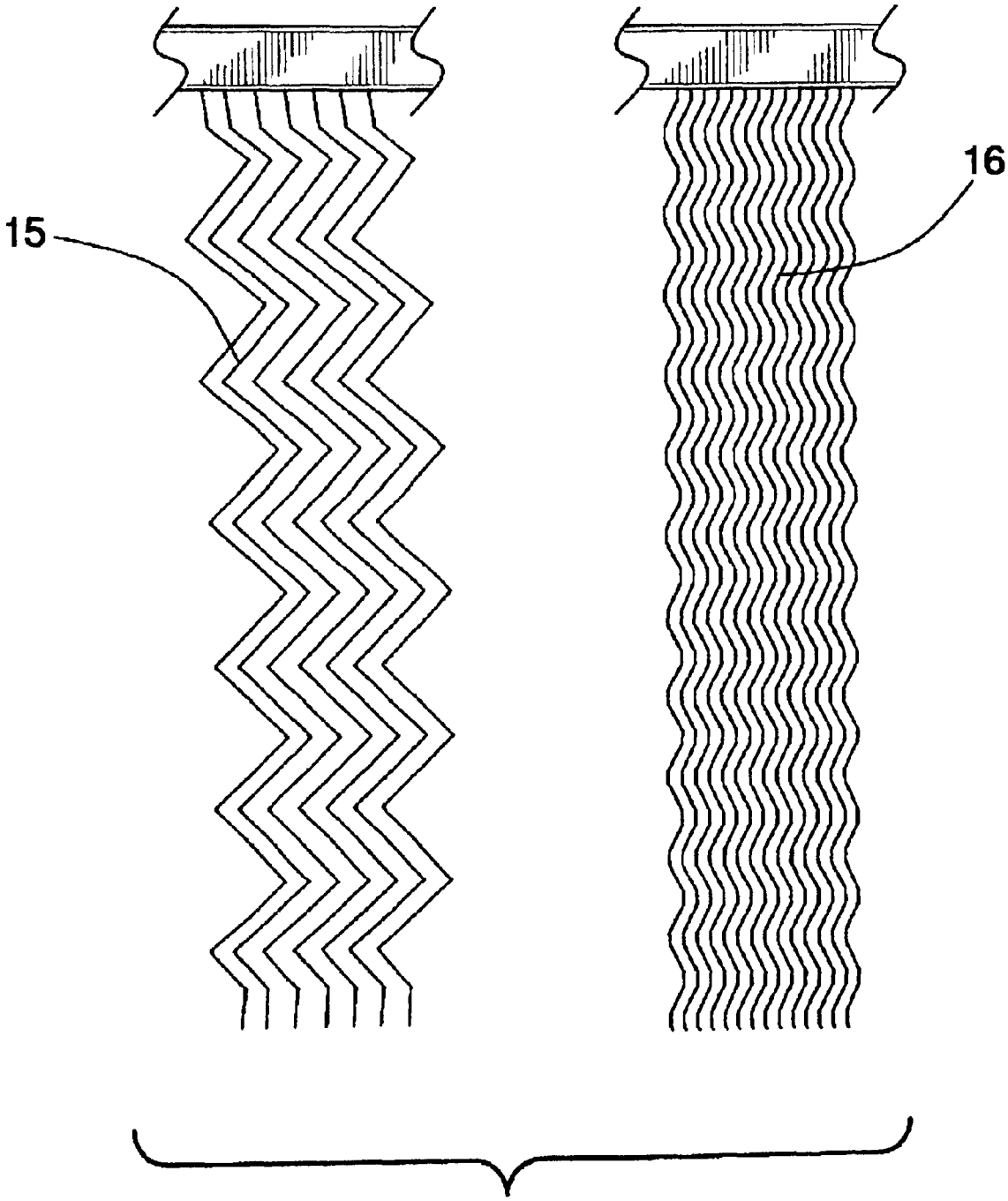
FIG. 4 is a side elevational view of highlight strands of the present invention.

With reference now to the drawings, and in particular to FIGS. 1 through 4 thereof, a new hair highlights attachment assembly embodying tie principles and concepts of the present invention and generally designated by the reference numeral 10 will be described.

As best illustrated in FIGS. 1 through 4, the hair highlights attachment assembly 10 generally comprises a highlight strands support member 11 being adapted to be removably disposed about a user's hair 19 and head 18. The highlight strands support member 11 is an arcuate hair/head band having an underside 12 and being adapted to be removably placed upon one's hair 19 and head 18.

Fasteners 13 are conventionally attached to the highlight strands support member 11. The fasteners 13 include a strip of hook and loop fasteners being securely and conventionally attached and adhered to and extending along the underside 12 of the arcuate hair/head band 11.

A plurality of highlight strands 14–16 are detachably and conventionally attached to the highlight strands support member 11. The highlight strands 14–16 include squiggly-shaped highlight strands 16 and also include zigzag-shaped highlight strands 15.

Fastening members 17 are conventionally attached to the highlight strands 14–16. Each of the fastening members 17 is securely and conventionally attached at an end of a respective one of the highlight strands 14–16 and is securely and detachably attached to the fasteners 13. Each of the fastening members 17 is a flexible, foldable piece of material which is folded about an end of a respective one of the highlight strands 14–16. The flexible, foldable piece of material has a sponge-like texture.

In use, the user attaches the desired style of highlight strands 14–16 to the fasteners 13 which are attached to the arcuate hair/head band 11; and then places the arcuate hair/head band 11 upon one's head 18 with the highlight strands 14–16 extending outwardly from the arcuate hair/head band 11 and upon one's hair 19.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the hair highlights attachment assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair highlights attachment assembly comprising:

a highlight strands support member being removably disposed about a user's hair and head, said highlight strands support member being an arcuate hair/head band having an underside and being removably placed upon one's hair and head, said highlight strands including squiggly-shaped highlight strands and also including zigzag-shaped highlight strands;

fasteners being attached to said highlight strands support member, said fasteners including a strip of hook and loop fasteners being secured attached to and extending along said underside of said arcuate hair/head band;

a plurality of highlight strands being detachably attached to said highlight strands support member; and fastening members being attached to said highlight strands, each of said fastening members being securely attached at an end of a respective one of said highlights strands and being securely and detachably attached to said fasteners, each of said fastening members being a flexible, foldable piece of material which is folded about an end of a respective one of said highlight strands, said flexible, foldable piece of material having a sponge-like texture.

* * * * *